United States Patent [19]

Toya et al.

[11] Patent Number: 4,659,960

[45] Date of Patent: Apr. 21, 1987

[54] ELECTRODE STRUCTURE FOR A SPARK PLUG

[75] Inventors: Akihiro Toya; Junichi Kagawa; Kazunori Yokota; Hiroaki Mori, all of Aichi, Japan

[73] Assignee: NGK Spark Plug Co., Ltd., Aichi, Japan

[21] Appl. No.: 731,942

[22] Filed: May 8, 1985

[30] Foreign Application Priority Data

May 9, 1984 [JP] Japan ..... 59-90900
May 21, 1984 [JP] Japan ..... 59-100374
May 31, 1984 [JP] Japan ..... 59-109696

[51] Int. Cl.[4] ..... H01T 13/16; H01T 13/20
[52] U.S. Cl. ..... 313/141; 313/11.5
[58] Field of Search ..... 313/131 A, 141, 142, 313/144, 145, 115

[56] References Cited

U.S. PATENT DOCUMENTS 4,144,474 3/1979 Nishio et al. ..... 313/131 A
4,400,643 8/1983 Nishio et al. ..... 313/141 X
4,414,483 11/1983 Nishio et al. ..... 313/141 X
4,427,915 1/1984 Nishio et al. ..... 313/141

*Primary Examiner*—Palmer C. DeMeo
*Assistant Examiner*—Sandra L. O'Shea
*Attorney, Agent, or Firm*—Finnegan, Henderson, Farabow, Garrett & Dunner

[57] ABSTRACT

A spark plug having a center electrode comprises a ceramic insulator whose leg portion is shaped at the tip in a bag form so as to close the insulator bore. A firing tip is provided at the bag-shaped tip in a face-to-face relation with a side electrode by fixing an electrode element made of a sinter of a ceramic powder containing particles of a size between 10 and 200 μm which are coated with a noble metal to a thickness of 0.1–20 μm. An electrode axis extends from the top end of the plug and is inserted through the insulator bore.

5 Claims, 15 Drawing Figures

FIG. 1
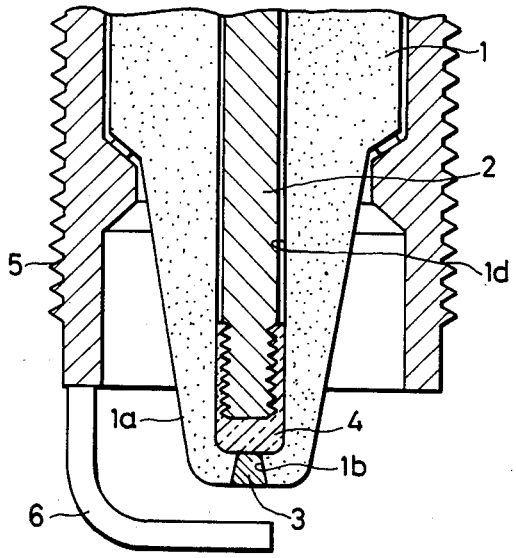
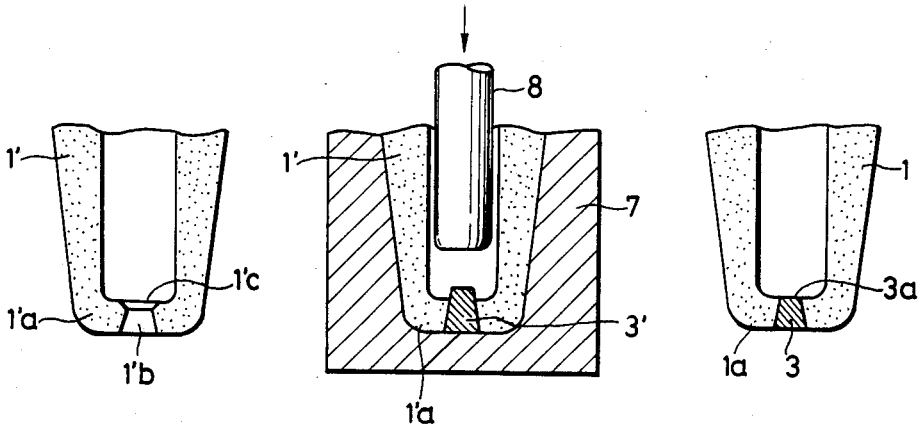
FIG.2(a) FIG.2(b) FIG.2(c)

FIG. 3
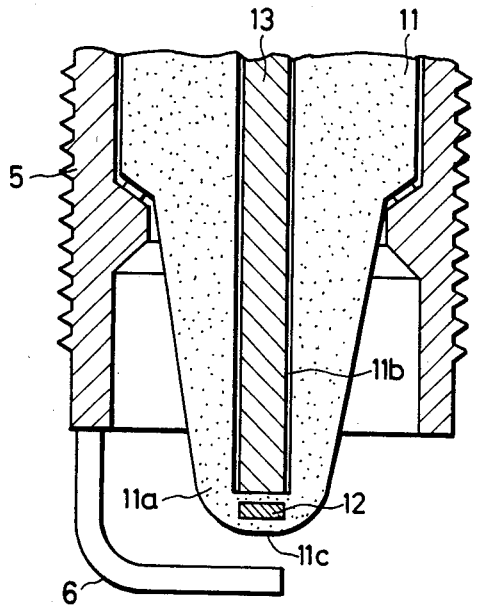
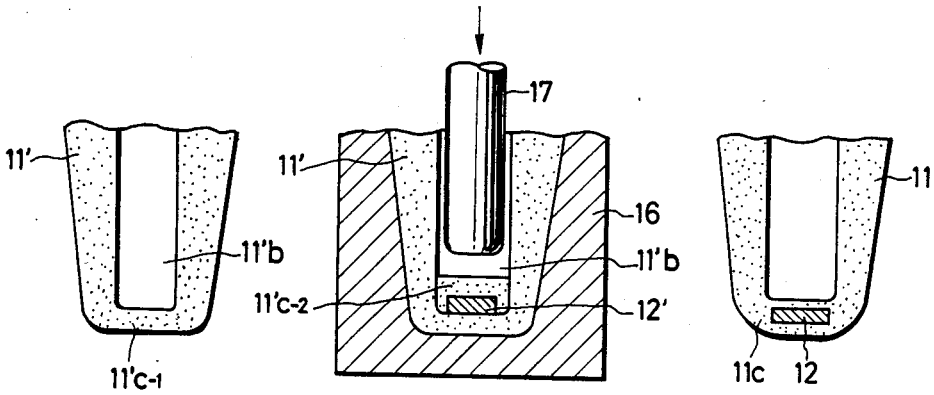
FIG.4(a) FIG.4(b) FIG.4(c)

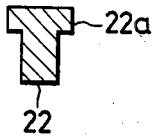
FIG.5(a)
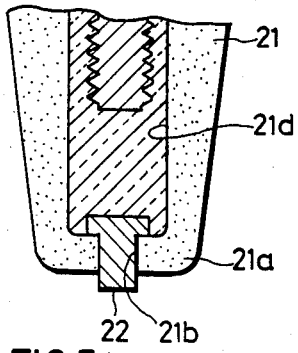
FIG.5(b)
FIG. 6
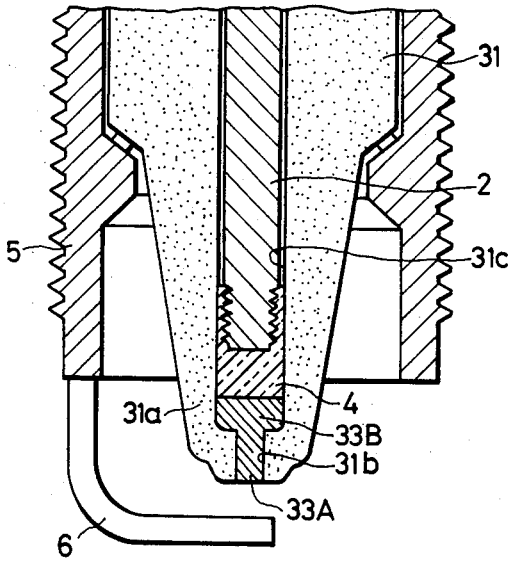

ELECTRODE STRUCTURE FOR A SPARK PLUG

BACKGROUND OF THE INVENTION

1. Field of Invention

The present invention relates to a spark plug for use with an internal combustion engine, and more particularly, to the center electrode thereof having an improved construction.

2. Prior Art

The tip of the center electrode of a spark plug is directly exposed to a hot air-fuel mixture in the combustion chamber of an internal combustion engine. Therefore, the spark is required to have not only high chemical durability which is capable of withstanding service under hostile conditions but also great resistance to the wear that results from spark discharge. In order to meet these requirements, a noble metal tip is attached to the center electrode or the corresponding surface of the side electrode.

The spark plug with the noble metal firing tip has an improved spark resistance but the use of an expensive noble metal unavoidably increases the cost of the spark plug. Furthermore, spark plugs of this type are not adapted to high volume production since securely attaching the noble metal tip to the electrode axis involves special working and welding techniques.

SUMMARY OF THE INVENTION

In accordance with a first aspect of the present invention, an inexpensive spark plug that is adapted to high volume production is provided by forming the firing tip of the center electrode with a sinter of ceramic powder comprising noble metal coated particles that is disposed at the tip of a closed ceramic insulator in a bag form. This spark plug is inexpensive since it uses a minimum amount of a noble metal; it is also adapted to high volume production since the conventional step of welding the nobel metal tip to the electrode axis is no longer necessary.

In accordance with a second aspect of the present invention, a spark plug is provided whose firing tip has sufficiently good heat conduction to permit faster heat dissipation when the plug is exposed to high temperatures. This spark plug is characterized by using a center electrode that consists of the following three basic components: one is a bottom firing electrode portion that is made of a sinter of noble metal coated $Al_2O_3$ particles and which is packed in the lower part of a small diameter bore at the bottom of the leg of a ceramic insulator that is closed at the tip in a bag form; the second component is a top firing electrode portion that is made of a powder comprising heat conductive metallic particles coated with a noble metal and which is placed in contact with the top of said bottom firing electrode portion and packed both in the upper part of the small diameter bore and on the bottom of the center hole in the ceramic insulator; and the third component is an electrode axis that is inserted through said center hole and which is joined or placed in contact with the top firing electrode portion.

In accordance with a third aspect of the present invention, there is provided a highly heat- and wear-resistant spark plug which may also be used as a high-performance projecting spark plug. This spark plug comprises an insulator, a firing electrode that is made of a noble metal cermet or a like material and attached to the bottom (tip) of the insulator to close it in a bag form, and a metal base powder that is packed in the insulator bore in contact with the top of the firing electrode and which is sealed at the top with an electroconductive glass with a central electrode being optionally inserted between said metal base powder and the conductive glass seal. The tip of the insulator may be protruded from the bottom of a metal holder by a distance of 3–10 mm so as to produce a projecting spark plug.

BRIEF DESCRIPTION OF THE DRAWINGS

FIG. 1 is a longitudinal section of the essential parts of the spark plug in accordance with one embodiment of the first aspect of the present invention;

FIGS. 2(*a*), 2(*b*), and 2(*c*) shows schematically the process of attaching a firing tip to the ceramic insulator in the spark plug shown in FIG. 1;

FIG. 3 is a longitudinal section of the essential parts of the spark plug in accordance with another embodiment of the first aspect of the present invention;

FIGS. 4(*a*), 4(*b*), and 4(*c*) shows schematically the process of embedding a firing tip in the ceramic insulator in the spark plug shown in FIG. 3;

FIGS. 5(*a*) and 5(*b*) shows schematically the process of attaching a firing tip to the ceramic insulator in the spark plug in accordance with a further embodiment of the first aspect of the present invention;

FIG. 6 is a longitudinal section showing the essential parts of the spark plug in accordance with one embodiment of the second aspect of the present invention;

DETAILED DESCRIPTION OF THE INVENTION

Figure 7:
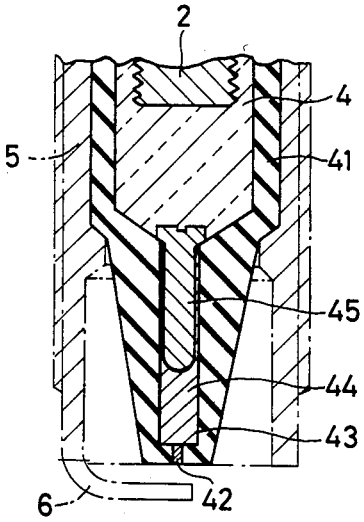
FIG. 7 is a longitudinal section showing the essential parts of the spark plug in accordance with one embodiment of the third aspect of the present invention.

The spark plug in accordance with the first aspect of the present invention is hereunder described by reference to FIGS. 1 to 5. FIG. 1 is a longitudinal section depicting one embodiment of the spark plug in accordance with the first aspect of the invention. The center electrode of this spark plug comprises a ceramic insulator (1) made of a high alumina ($\geqq 90\%$ $Al_2O_3$) porcelain and an electrode axis (2) made of Ni or other heat-resistant non-precious metals. The leg (1*a*) of the insulator (1) is closed in a bag form except that a small diameter hole (1*b*) is made at the tip. This hole (1*b*) is filled with an electrode element (3) that is made of a sinter of a ceramic powder comprising particles (10–200 $\mu$m in size) that are coated with a noble metal to a thickness of 0.1–20 $\mu$m. This electrode element (3) which serves as the firing tip of the center electrode is joined to the electrode axis (2) in the insulator bore (1*d*) by means of a conventional electro-conductive glass seal (4) which is a mixture of glass and a metal powder. The spark plug in FIG. 1 also includes a metal holder (5) for the ceramic insulator 1 and a side electrode (6) extending from said metal holder.

The ceramic powder which is the basic component of the electrode element 3 may be selected from a variety of ceramic materials that include oxide ceramics such as alumina ($Al_2O_3$), mullite ($3Al_2O_3.2SiO_2$), zirconia ($ZrO_2$), sialon (solid solution of alumina and silicon nitride, $Si_3N_4$), spinel ($MgO.Al_2O_3$) and forsterite ($2MgO.SiO_2$); carbide ceramics such as silicon carbide (SiC), titanium carbide (TiC), boron carbide ($B_4C$) and chromium carbide ($Cr_3C_2$); and silicide ceramics such as NiSi and MoSi. Such ceramic particles are coated with noble metal materials which are either pure noble metals (e.g. Pt, Ir, Rh and Pd) or alloys of two or more of such noble metals. A variety of coating techniques may be employed, such as CVD and PVD processes (evaporation, ion plating and sputtering). The coated particles are blended together with a suitable binder. The process of attaching the electrode element (3) to the tip of the ceramic insulator is illustrated in FIG. 2. First, a molded and calcined ceramic insulator (1') having a small-diameter hole (1'*b*) in the leg portion (1'*a*) as shown in FIG. 2(*a*) is provided. The hole (1'*b*) may be cylindrical or frustoconical. Then, as shown in FIG. 2(*b*), a cylindrical or wedge-shaped electrode element (3') is inserted into the small hole (1'*b*) and the insulator (1') is set in a press mold (7). A press pin (8) is inserted into the insulator bore and pushed down in the direction indicated by the arrow so that the top of the electrode element (3') is collapsed to become flush with the inner surface of the insulator bottom. Finally, the electrode element (3') as well as the ceramic insulator (1') are sintered at ca. 1,600° C. to provide an assembly which, as shown in FIG. 2(*c*), has the electrode element (3) fixed securely in the tip of the leg (1*a*) of the ceramic insulator (1). If desired, the electrode element (3') inserted into the hole (1'*b*) may be immediately sintered with the ceramic insulator (1') without collapsing the top of the electrode element as shown in FIG. 2(*b*).

The periphery of the top of the small hole (1'*b*) in the insulator leg (1'*a*) is preferably chamfered as indicated by (1'*c*) in FIG. 2(*a*) in order to facilitate the securing of the flush end (3*a*) (see FIG. 2(*c*)) of the electrode element (3) to the insulator (1).

In accordance with another method for attaching the electrode element (3) to the tip of the ceramic insulator (1), a calcined electrode element is placed at a predetermined position on the bottom of a mold and after filling the mold with an insulator powder, press forming is effected to make a ceramic insulator. The so obtained ceramic insulator carrying the electrode element on the bottom is sintered after collapsing the top of the electrode element by the steps shown in FIGS. 2(*a*) and (*b*). Again, the collapsing step may be omitted if desired.

FIG. 3 is a longitudinal section showing the essential parts of the spark plug in accordance with another embodiment of the first aspect of the present invention. As shown, an insulator (11) made of a high-alumina porcelain has a leg portion (11*a*) which is closed in a bag form so as to completely seal the insulator bore (11*b*), and an electrode element (12) which, as described in the embodiment shown in FIG. 1, is made of a ceramic powder comprising noble-metal coated particles is embedded in the tip (11*c*) of the leg. An electrode axis (13) made of Ni or other heat-resistant non-precious metals is inserted through the insulator bore (11*b*) and the tip of this axis extending to the bottom of the insulator bore (11*b*) is positioned to face the top of the electrode element (12) within the insulator tip (11*c*). Aside from the construction of the center electrode shown above, the spark plug depicted in FIG. 3 is essentially the same as the plug in FIG. 1.

The process of embedding the electrode element (12) in the insulator tip (11*c*) is illustrated in FIG. 4. First, an insulator (11') made of a calcined high-alumina porcelain powder which has the bore (11'*b*) closed at the tip ($11'_{c\text{-}1}$) is provided as shown in FIG. 4(*a*). Then, an electrode element (12') is placed on the bottom of the insulator bore (11'*b*) and a predetermined amount of a ceramic material ($11'_{c\text{-}2}$) which is made of the same material as that of the insulator (11') is placed on top of the electrode element (12') as shown in FIG. 4(*b*). The insulator (11') is set in a press mold (16) and a press pin (17) is pushed down in the direction indicated by the arrow in FIG. 4(*b*). After sintering the insulator (11'), the surface of the pressed ceramic material ($11'_{c\text{-}2}$) is ground, thereby providing an assembly which, as shown in FIG. 4(*c*), has the electrode element (12) embedded in the insulator tip (11*c*).

In accordance with another method for embedding the electrode element in the insulator tip, a ceramic insulator material is placed in a small amount in the cavity of the press mold (16). After placing the electrode element (12') on top of the insulator material, the press pin (17) is inserted into the mold cavity and another portion of the ceramic insulator material is charged into the cavity. The charged material is press-formed to make the insulator (11), which is subsequently sintered to form an assembly wherein the electrode element (12) is buried in the tip (11*c*).

In the two embodiments shown above, the electrode axis is made of Ni or other heat-resistant non-precious metals. If desired, a resistive material comprising glass, a metal powder, a metal oxide, a metal carbide and a heat-resistant inorganic material as conventionally used in resistor-loaded spark plugs (see, for example, U.S. Pat. No. 4,144,474) may be inserted as an electrode axis through the bore of the ceramic insulator.

FIG. 5 shows a further embodiment of the spark plug in accordance with the first aspect of the present invention. The process of fabricating this spark plug proceeds as follows. First, a ceramic powder comprising noble-metal coated particles is shaped into a cylindrical form which may optionally be provided with a flange (22*a*) at the top. The compact is then fired at a predetermined temperature to make an electrode element (22) (see FIG. 5(*a*)). The electrode element is inserted through a small-diameter holw (21*b*) in the tip (21*a*) of a ceramic insulator (21) made of a high-alumina sinter, with the top of the electrode element protruding into the insulator bore (21*d*). As in the case of the previous two embodiments, the electrode element (22) is connected to the electrode axis and fixed in the insulator bore by means of a glass seal.

As described in the foregoing, the firing tip of the center electrode of the spark plug in accordance with the first aspect of the present invention has an electrode element made of a sinter of ceramic powder comprising noble metal coated particles. Therefore, the spark plug in accordance with the first aspect of the invention uses a smaller amount of noble metal than is required in the conventional product and yet achieves comparable resistance to the wear resulting from spark discharge. Additionally, the absence of the intricate step of welding a noble metal tip to the center electrode makes the spark plug of the present invention more adaptive to high volume production. A center electrode with a longer life can be obtained by embedding the electrode member in the tip of a ceramic insulator because this construction is effective in preventing the scattering of noble metal particles that results from cyclic spark discharge. In short, the spark plug in accordance with the first aspect of the present invention has high durability and can be manufactured in high volume at low cost.

FIG. 6 is a longitudinal section showing the essential parts of the spark plug in accordance with the second aspect of the present invention. As shown, the center electrode of the spark plug comprises a ceramic insulator (31) made of a high-alumina porcelain and an electrode axis (2) made of a low-thermal-expansion and highly heat-resistant alloy such as Ni alloy or a fernico (Fe-Ni-Co) alloy. The ceramic insulator (31) has a leg portion (31*a*) that is tapered in a bag form and has a small-diameter hole (31*b*) bored in it. The lower part of the hole (31*b*) is filled with a bottom firing electrode portion (33A) is placed a top firing electrode portion (33B) that fills both the upper part of the hole (31*b*) and the bottom portion of the insulator bore (31*c*). The top firing electrode portion (33B) is joined to the electrode axis (2) in the bore (31*c*) by means of a conventional glass seal (14) which is a mixture of glass and a metal powder.

The spark plug shown in FIG. 6 also includes a metal holder (5) for the ceramic insulator (31) and a side electrode (6) extending from said holder.

As mentioned above, the lower part of the small hole (31*b*) in the insulator leg (31*a*) is filled with the bottom firing electrode portion (33A). This is made of a powder comprising alumina ($Al_2O_3$) particles ($\leqq 100$ μm in size) that are coated with a noble metal material (either a pure noble metal such as Pt, Ir, Pd or Rh or an alloy of two or more of such noble metals) to a thickness of 0.1–20 μm by a suitable technique selected from among CVD and PVD processes (e.g. evaporation and sputtering). The coated particles are blended together with a suitable binder. The mix is compacted to a predetermined shape which is calcined, inserted into the lower part of the small hole (31*b*) in the insulator leg (31*a*) and sintered together with the insulator.

The top firing electrode portion (33B) is then packed both in the upper portion of the hole ( 31*b*) and on the bottom of the insulator bore (31*c*). This top firing electrode portion (33B) is made of a powder comprising heat-conductive metal (e.g. BeO, Cu, W, Mo or Ni) particles ($\leqq 100$ μm in size that are coated with a pure metal (e.g. Pt, Ir, Pd or Rh) or an alloy thereof to a thickness of 1–20 μm by a suitable technique such as CVD or PVD processes (e.g. evaporation and sputtering). Such coated particles are filled both into the upper part of the cavity (31*b*) above the bottom firing electrode portion (33A) and on the bottom of the insulator bore (31*c*). The resulting top firing electrode portion (33B) is joined to the electrode axis (2) by an electroconductive glass seal (4).

As shown above, the firing tip at the center electrode of the spark plug in accordance with the second embodiment of the present invention has a dual structure consisting of the bottom and top firing electrode portions. The bottom firing elecrrode portion is made of a sinter of a ceramic powder comprising $Al_2O_3$ particles coated. with a noble metal. The top firing electrode portion placed above this bottom electrode is made of heat conductive metal particles coated with a noble metal. The metals used in the top firing electrode portion have high heat conductivities: BeO=0.524 cal/cm-.deg. at 100° C., Cu=0.94 cal/cm. deg. at 0°–100° C., W=0.397 cal/cm.deg. at 20° C., Mo=0.34 cal/cm.deg. at 20° C., and Ni=0.21 cal/cm.deg. at 0° C. These high heat conductivities, combined with the use of noble metals, contribute to the production of a highly heat conductive firing electrode which dissipates a sufficiently large amount of heat to cool down rapidly when it becomes hot. As a result, the electrode has an increased spark resistance and can be used for a prolonged period. In short, the spark plug in accordance with the second aspect of the present invention has high durability and can be manufactured in high volume at low cost.

FIG. 7 is a longitudinal section showing the essential parts of one embodiment of the spark plug in accordance with the third aspect of the present invention. As shown, this spark plug comprises an alumina insulator (41) which has a small hole at the tip filled with a firing electrode (42) to provide a bag-shaped tip. The firing electrode (42) is made of a noble metal (Pt, Pt-Ir or Pt-Rh) cermet (a mixture of noble metal and ceramic powders, or ceramic particles coated with a noble metal as used in the spark plug in accordance with the first or second aspect of the invention) and is sintered together with the insulator (41). In the insulator bore (43) above the firing electrode (42) is placed a powder (44) comprising low-thermal-expansion metal (e.g. W, Mo, Fe-Ni, Fe-Ni-Co or Cr-Ni alloy) particles with a size of 0.1–50 μm, preferably 1–20 μm. Thereafter, a center electrode (45) is inserted into the insulator bore (43) and pressed to ensure intimate contact between the firing electrode (42) and the powder (44). Finally, the center electrode (45) is secured to a terminal electrode (2) by hot-pressing a conductive glass seal (4) in a known method.

In the spark plug shown in FIG. 7, the powder (44) has a close thermal expansion match with the alumina insulator (41) as shown below:

| | |
|---|---|
| alumina | $7\text{–}8 \times 10^{-6}$ (°C.$^{-1}$) |
| tungsten | $4.6 \times 10^{-6}$ (°C.$^{-1}$) |
| molybdenum | $5.7 \times 10^{-6}$ (°C.$^{-1}$). |

In addition, the powder (44) has a very high thermal conductivity as shown below:

| | |
|---|---|
| tungsten | 0.4 cal/cm. deg. (at 20° C.) |
| molybdenum | 0.34 cal/cm. deg. (at 20° C.) |
| nickel | 0.21 cal/cm. deg. (at 20° C.). |

Since the powder (44) is isolated from the atmosphere by the barrier of conductive glass seal (4), there is no possibility of the powder being oxidized to lose its electro-conductive nature. As a result, the firing electrode and the tip of the alumina insulator maintain efficient heat dissipation so as to provide a spark plug having improved resistance to heat and spark wear.

Figure 8:
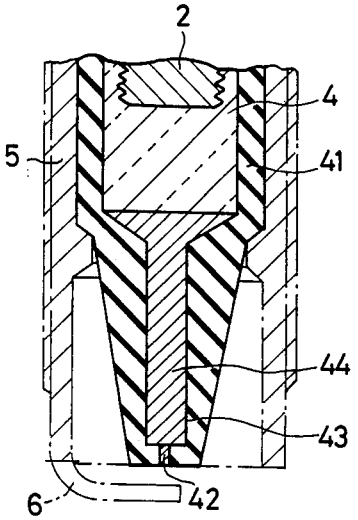
FIGS. 8 to 10 are longitudinal sections showing the essential parts of the spark plugs in accordance with other embodiments of the third aspect of the present invention.

FIG. 8 shows another embodiment of the spark plug in accordance with the third aspect of the present invention. This spark plug is the same as that shown in FIG. 7 except that the powder (44) placed on top of the firing electrode (42) is pressed and directly sealed with the conductive glass (4) without inserting the center electrode (45).

Figure 9:
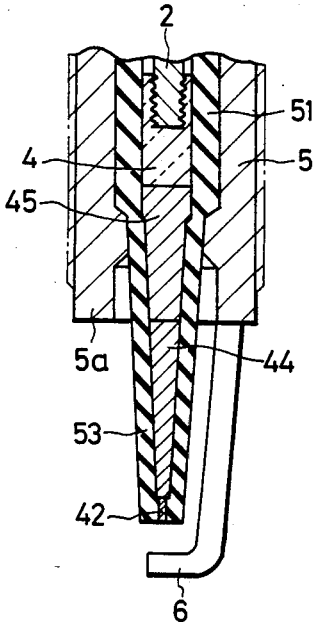

FIG. 9 depicts a further embodiment of the spark plug in accordance with the third aspect of the present invention. In this embodiment, an insulator (51) is fitted into a metal holder (5) from which a side electrode (6) extends downwardly. The tip of the insulator projects from the bottom (5*a*) of the metal holder (5) by a distance of 3–10 mm so that the firing element (42) fixed at the tip of the insulator (51) has a predetermined gap from the side electrode (6). As in the case of the first embodiment shown in FIG. 7, the insulator bore (53) is filled with a metal (e.g. W) based powder (44) to a point close to the base (5a) of the metal holder (5). Above this powder (44) is inserted the central electrode (45) which is secured to the terminal electrode (2) by the conductive glass seal (4).

The spark plug shown in FIG. 9 is of the projecting type and this type of spark plug is characterized by constant exposure of the tip of the insulator (51) to high temperatures. However, in accordance with the embodiment shown in FIG. 9, the powder (44) provides reliable protection against the melting of the central electrode (45). Another advantage results from the fact that the diameter of the firing tip (42) may be as small as 0.3–0.5 mm; this permits a correspondingly small diameter for the insulator bore (53) that is to be filled with the powder (44) and the outside diameter of the overall insulator (51) can be reduced to such an extent that it is spaced from both the side electrode (6) and the metal holder (5) by a sufficiently large gap to entirely eliminate the chance of leak current (or flashover).

Figure 10:
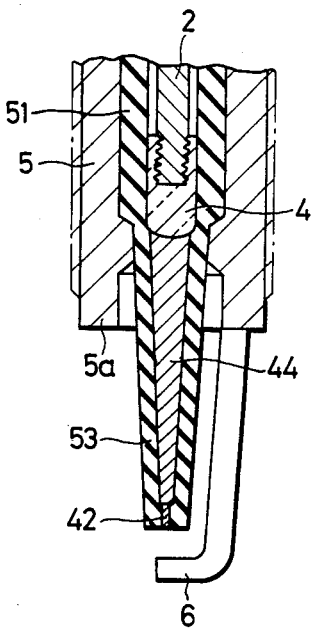

FIG. 10 shows a still further embodiment of the spark plug in accordance with the third aspect of the present invention. This spark plug is the same as that shown in FIG. 9 except that the powder (44) placed on top of the firing electrode (42) is pressed and directly sealed with the conductive glass (4) without inserting the central electrode (45).

As described above by reference to the four different embodiments, the spark plug in accordance with the third aspect of the present invention uses a noble metal cermet in the firing electrode, on which lies a metal based powder that is sealed with conductive glass. The powder on top of the firing electrode is protected against aerial oxidation and ensures good electrical connection to both the firing electrode and the terminal electrode. Additionally, the close thermal expansion matching between the insulator and the powder or the conductive glass seal prevents the occurrence of any crack in these components at elevated temperatures. Thus, in accordance with the third aspect of the present invention, a spark plug having high heat- and wear-resistance can be fabricated at low cost.

The spark plug in accordance with the third aspect of the invention may be modified to the projecting type that will operate reliably even if the tip is exposed to high temperature because the powder placed below the central electrode prevents any possibility of its melting. Additionally, the projecting spark plug in accordance with the third aspect of the present invention uses an insulator having a sufficiently small diameter to eliminate the occurrence of the leak current due to flashover. In consideration of these facts, the projecting spark plug of the present invention will be of great assistance in the current efforts being made by car manufacturers toward achieving a lower degree of exhaust emission and better gas mileage.

What is claimed is:

1. A spark plug comprising a ceramic insulator having a top end and a tapered portion with a decreasing diameter towards a bottom end;

said ceramic insulator having a central bore extending from the top end of the insulator and a bottom end bore extending from the bottom end of the insulator to the central bore, said bottom end bore having a smaller diameter than said central bore;

a terminal electrode disposed in said central bore;

an electrode element comprised of sintered ceramic powder particles of a size between 10 and 200 μm coated with a noble metal to a thickness of 0.1 to 20 μm disposed in said bottom end bore, said electrode element being joined to said terminal electrode by electro-conductive glass sealing means in a manner such that said electrode elements serves as a firing tip for said terminal electrode;

metal holder means supporting said ceramic insulator; and a ground electrode connected to said metal holder means, said ground electrode being positioned so as to form a gap with said electrode element.

2. A spark plug comprising a ceramic insulator having a top end and a tapered portion with a decreasing diameter towards a bottom end, said ceramic insulator having a central bore extending from the top end to just before the bottom end of the insulator and a bottom end bore extending from the bottom end of the insulator to the central bore, said bottom end bore having a smaller diameter than said central bore;

a terminal electrode disposed in said bore;

a bottom firing electrode element comprised of sintered ceramic powder particles smaller than 100 μm in size coated with a noble metal to a thickness of 1 to 20 μm disposed in a bottom portion of said bottom end bore, said bottom firing electrode element being fixed to said ceramic insulator by simultaneous sintering with said ceramic insulator;

a tip firing electrode element comprised of heat conductive metal powder particles smaller than 100 μm in size coated with a noble metal to a thickness of 1 to 20 μm disposed above said bottom firing electrode element in a top portion of said central bore, said top firing electrode element being joined to said terminal electrode by electro-conductive glass sealing means;

metal holder means supporting said ceramic insulator; and a ground electrode connected to said metal holder means, said ground electrode being positioned so as to form a gap with said bottom firing electrode element and said top firing electrode element.

3. A spark plug according to claim 2, wherein said metal powder comprises a material selected from a group consisting of W, Mo, W-Mo alloy, Fe-Ni alloy, Fe-Ni-Co alloy and Cr-Ni alloy, said material being of 0.1 to 50 micron diameter and having a low expansion coefficient.

4. A spark plug comprising a ceramic insulator having a top end and a tapered portion with a decreasing diameter towards a bottom end, said ceramic insulator having a central bore extending from the top end to just before the bottom end of the insulator to said central bore, said bottom end bore having a smaller diameter than said central bore;

a firing electrode element comprised of sintered ceramic powder particles of a size between 10 and 200 μm coated with a noble metal to a thickness of 0.1 to 20 μm disposed in said bottom end bore, said firing electrode element being fixed by to said ceramic insulator simultaneous sintering with said ceramic insulator;

low thermal expansion metal powder particles of a size of 0.1 to 50 μm disposed in said central bore above said firing electrode element;

a center electrode in said central bore pressing said low thermal expansion metal powder particles into contact with said firing electrode element;

a terminal electrode disposed in said central bore above said central electrode, said central electrode being fixed to said terminal electrode by electroconductive glass sealing means;

metal holder means supporting said ceramic insulator; and a ground electrode connected to said metal holder means, said ground electrode being positioned so as to form a gap with said firing electrode element.

5. A spark plug according to claim 4, wherein said metal powder comprises a material selected from a group consisting of W, Mo, W-Mo alloy, Fe-Ni alloy, Fe-Ni-Co alloy and Cr-Ni alloy, said material being of 0.1 to 50 micron diameter and having a low expansion coefficient.

* * * * *